US008683793B2

(12) United States Patent
Bergström et al.

(10) Patent No.: US 8,683,793 B2
(45) Date of Patent: Apr. 1, 2014

(54) METHOD FOR RECUPERATING POTENTIAL ENERGY DURING A LOWERING OPERATION OF A LOAD

(75) Inventors: Magnus Bergström, Eskilstuna (SE); Johan Lillemets, Eskilstuna (SE); Kim Heybroek, Linköping (SE); Jan-Ove Palmberg, Linköping (SE)

(73) Assignee: Volvo Construction Equipment AB, Eskilstuna (SE)

( * ) Notice: Subject to any disclaimer, the term of this patent is extended or adjusted under 35 U.S.C. 154(b) by 831 days.

(21) Appl. No.: 12/600,524

(22) PCT Filed: Mar. 25, 2008

(86) PCT No.: PCT/SE2008/000215

§ 371 (c)(1), (2), (4) Date: Nov. 17, 2009

(87) PCT Pub. No.: WO2008/143568

PCT Pub. Date: Nov. 27, 2008

(65) Prior Publication Data

US 2010/0154399 A1 Jun. 24, 2010

(30) Foreign Application Priority Data

May 18, 2007 (SE) ..... 0701248

(51) Int. Cl.
*F15B 11/024* (2006.01)

(52) U.S. Cl.
USPC ..... 60/414; 60/452

(58) Field of Classification Search
USPC ..... 60/414, 451, 452; 91/440
See application file for complete search history.

(56) References Cited

U.S. PATENT DOCUMENTS

| | | | | |
|---|---|---|---|---|
| 5,784,945 | A * | 7/1998 | Krone et al. | 91/459 |
| 6,467,264 | B1 * | 10/2002 | Stephenson et al. | 60/460 |
| 6,502,393 | B1 * | 1/2003 | Stephenson et al. | 60/414 |
| 6,854,268 | B2 * | 2/2005 | Fales et al. | 60/414 |
| 6,880,332 | B2 * | 4/2005 | Pfaff et al. | 60/422 |
| 7,614,336 | B2 * | 11/2009 | VerKuilen et al. | 91/446 |
| 7,634,911 | B2 * | 12/2009 | Brinkman | 60/414 |
| 2003/0221339 | A1 | 12/2003 | Naruse et al. | |
| 2004/0035103 | A1 | 2/2004 | Nagura et al. | |
| 2004/0107699 | A1 | 6/2004 | Fales et al. | |
| 2006/0201146 | A1 * | 9/2006 | Tabor | 60/413 |

FOREIGN PATENT DOCUMENTS

| | | | |
|---|---|---|---|
| EP | 1403526 | A1 | 3/2004 |
| WO | 02090780 | A1 | 11/2002 |
| WO | 2006088399 | A1 | 8/2006 |

OTHER PUBLICATIONS

International Search Report for corresponding International Application PCT/SE2008/000215, Feb. 9, 2008.

International Preliminary Report on Patentability for corresponding International Application PCT/SE2008/000215, Nov. 3, 2009.

* cited by examiner

*Primary Examiner* — Thomas E Lazo
(74) *Attorney, Agent, or Firm* — WRB-IP LLP

(57) ABSTRACT

A method is provided for recuperating potential energy during a lowering operation of a load, wherein a hydraulic system is adapted to lift and lower the load. In the method, at least two energy recuperation modes are provided, one of the modes is selected in response to a current operating state, and the hydraulic system is controlled according to the selected mode.

19 Claims, 10 Drawing Sheets

METHOD FOR RECUPERATING POTENTIAL ENERGY DURING A LOWERING OPERATION OF A LOAD

BACKGROUND AND SUMMARY

The present invention relates to a method for recuperating potential energy during a lowering operation of a load. The invention is especially applied in operation of a work machine.

The term "work machine" comprises different types of material handling vehicles like construction machines, such as a wheel loader, an excavator, a backhoe loader and a dump truck (such as an articulated hauler). A work machine is provided with a bucket, container or other type of work implement for carrying/transporting a load. Further terms frequently used for work machines are "earth-moving machinery", "off-road work machines" and "construction equipment".

In connection with transportation of heavy loads, e.g. in contracting work, work machines are frequently used. A work machine may be operated with large and heavy loads in areas where there are no roads, for example for transports in connection with road or tunnel building, sand pits, mines and similar environments.

The invention will be described below for a wheel loader. This should be regarded as a non-limiting example of a work machine. The wheel loader comprises a driveline for propelling the machine via the wheels. A power source, such as an internal combustion engine, and especially a diesel engine, is adapted to provide the power for propelling the wheel loader. The wheel loader further comprises a hydraulic system for performing certain work functions, such as lifting and tilting a work implement and steering the machine. The power source is also adapted to provide the power for controlling the hydraulic work functions. More specifically, one or more hydraulic pumps are driven by the power source in order to provide hydraulic actuators (such as hydraulic cylinders) with pressurized hydraulic fluid.

In order to recuperate potential energy, the hydraulic system may comprise a hydraulic machine which is adapted to function as both pump and motor. More precisely, the hydraulic machine functions as a pump in a lifting operation and supplies pressurized hydraulic fluid to the hydraulic cylinder. The hydraulic machine functions as a hydraulic motor in a lowering operation and is driven by a pressurized hydraulic fluid flow from the hydraulic cylinder. The lowering operation defines an energy recovery state.

It is desirable to achieve an energy recuperation method for a work machine, which creates conditions for an efficient recuperation of energy during a lowering operation of a load.

According to an aspect of the present invention, a method is provided for recuperating potential energy during a lowering operation of a load, wherein a hydraulic system is adapted to lift and lower the load, comprising the steps of

- providing at least two energy recuperation modes,
- selecting one of said modes in response to a current operating state, and
- controlling the hydraulic system according to the selected mode.

The term "load" here refers to the load exerted on the hydraulic system (especially on the hydraulic actuators) during the lowering operation, which load comprises a load resulting from the weight of a load arm assembly, which is adapted to lift and lower the load, and any external load (payload) carried by the load arm assembly.

Load actuation in different modes of operation creates conditions for hydraulically recuperating a greater portion of the mechanical load power.

Further, the method is designed for determining which of said at least two energy recuperation modes is most energy efficient and responsively selecting the most energy efficient recuperation mode. Further, the selection of energy recuperation mode is performed with respect to the constraints of the specific hydraulic system used with regard to a maximum system pressure etc. The selection of recuperation mode is for example made before initiating the lowering Operation.

According to a preferred embodiment, a first recuperation mode is associated to that a weight of the load is below a predetermined limit and a second recuperation mode is associated to that the load weight is above the predetermined limit.

For example, the predetermined limit represents a load state, in which a load arm assembly, which is adapted to lift and lower the load, is substantially free of any external load. In other words, the predetermined limit may correspond to a sum of the weight of the load arm assembly and a small additional weight corresponding to some stuck material in the load arm assembly etc.

According to a further preferred embodiment, a first recuperation mode is associated to that a load arm assembly, which is adapted to lift and lower the load, is lowered with substantially no external load.

Thus, in this case, only the load arm assembly is lowered after having dumped the external load in a raised position. Such operation is for example used in gravel handling. In gravel handling, the gravel is scooped up from ground level by means of a bucket, the bucket is thereafter raised and the collected gravel dumped in a raised position, for example on a container of a dump truck. The bucket is then returned (lowered) to the initial position for scooping up more gravel.

According to a further preferred embodiment, a second recuperation mode is associated to that a load arm assembly, which is adapted to lift and lower the load, is lowered with a substantial external load.

Such operation is applicable where an external load is collected from a raised position and lowered to a lowered position. This is for example the case in fork handling of pallets, wherein a pallet is collected from a shelf and lowered to ground level before transportation to a destination.

According to a further preferred embodiment, the load arm assembly comprises a work implement adapted to carry the external load. For example, the load arm assembly further comprises a boom, wherein the work implement (such as a bucket or forks) is connected to one end of the boom so that the work implement can be tilted relative to the boom.

According to a further preferred embodiment, the method comprises the step of detecting at least one operational parameter and determining the current operating state in response thereto.

According to one example of the last mentioned embodiment, a first operational parameter is indicative of a load state. Preferably, the current operating state is directly determined in response to the load state. Preferably, the first operational parameter is indicative of a pressure level in the hydraulic system.

According to a further example of the last mentioned embodiment, a second operational parameter is indicative of an operator commanded speed of the lowering motion.

Preferably, the current operating state is directly determined in response to the commanded speed. Especially, both the load state and the commanded speed are used as inputs for determining the operating state. For example, a position of an operator controlled element represents a commanded speed of the lowering motion. The aim is then to recuperate as much energy as possible given a desired actuator speed (commanded by the operator) at a given load acting on the actuator.

According to a further preferred embodiment, the method comprises the step of repeatedly detecting at least one operational parameter during operation in a repeated work cycle, and determining the current operating state based on detected values of the operational parameter during performance of at least one of said work cycles.

For example the current operating state is determined based on detected values of the operational parameter during performance of a plurality of said work cycles. The term "work cycle" comprises a movement of a work implement, such as a bucket, (lifting/lowering operation) and possibly any route of the work machine (ie the work cycle travel path) between a load collecting destination and a load release destination. The operational parameter is preferably only detected during the load lowering part of the work cycle. According to a first work cycle example, a wheel loader typically drives into a heap of material, lifts the bucket, reverses out of the heap, turns and is forwarded towards a dump truck where it unloads the material onto the container of the dump truck. After unloading, the bucket is lowered and the wheel loader returns to the starting position.

According to a further development of the last mentioned embodiment, the method comprises the step of repeatedly detecting said at least one operational parameter during operation in one of said at least two energy recuperation modes in the repeated work cycle, determining which of said at least two energy recuperation modes is most energy efficient for the specific work cycle, and responsively selecting the most energy efficient recuperation mode. The hydraulic system is controlled according to the selected energy recuperation mode in subsequent work cycles.

According to a preferred example, the hydraulic system comprises a hydraulic cylinder, which is configured to lift and lower the load, wherein the method comprises the step of controlling a flow from a piston side in the hydraulic cylinder during the lowering operation. Especially, a first energy recuperation mode involves controlling a flow communication between a piston-rod side and a piston side in the hydraulic cylinder during the lowering operation in a so-called differential mode. By using the differential mode, the flow to the pump may be reduced with about 30% with regard to a normal mode (in which there is no fluid flow connection between the piston-side and the piston-rod side). Thus, the pump size may be reduced. The differential mode causes a pressure increase in the system due to the area relationship in the cylinder. A relationship of 0.7 leads to a pressure increase with a factor in the magnitude of 3.3.

According to a first alternative, where higher lowering speed is required relative to what can be achieved in the normal mode due to the limited pump size, part of the flow may be throttled directly to tank if operation in the differential mode would result in a too high pressure level. This mode may be referred to as normal mode with meter-out flow control.

According to a second alternative, a valve is arranged in a line between the piston-side and the piston-rod side and the flow is throttled by means of the valve. In this way, the pressure level is limited. This mode is defined as a semi-differential mode. The power throttled away (pressure*flow) will be substantially smaller for high lowering speeds in the semi-differential mode compared to operation in the normal mode with meter-out flow control in case only a marginal pA-pB is required to stay below the maximum pressure level.

Similarly, in case of higher loads, the power throttled away (pressure*flow) will be substantially smaller in the normal mode with meter-out flow control where only a marginal meter out flow is required to achieve the desired lowering speed compared to operation in the semi-differential mode at the same operating point.

Further preferred embodiments of the invention are described in the following description.

BRIEF DESCRIPTION OF THE DRAWINGS

The invention will be explained below, with reference to the embodiments shown on the appended drawings, wherein FIG. 1 schematically shows a wheel loader in a side view.

DETAILED DESCRIPTION

Figure 1:
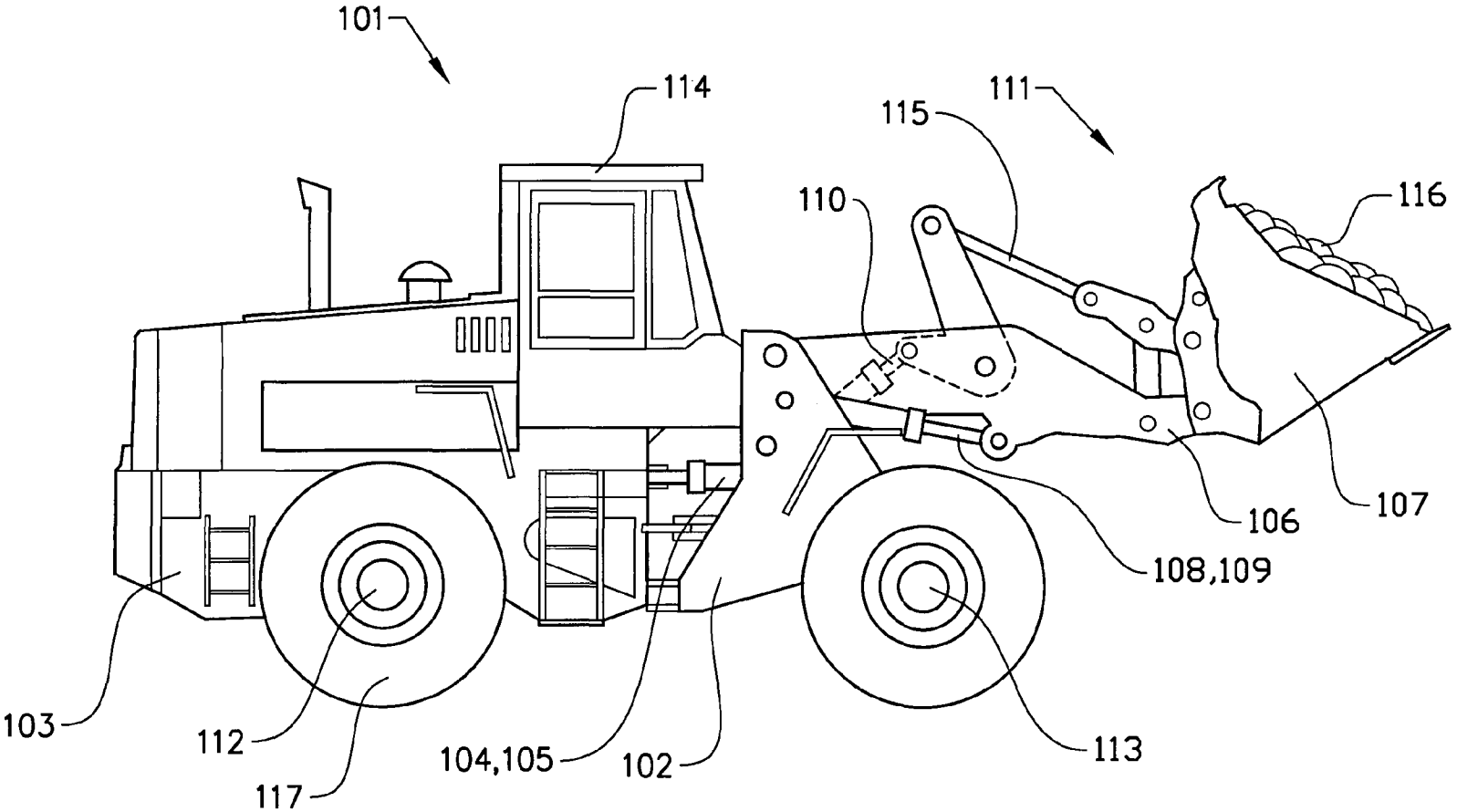

FIG. 1 shows a frame-steered work machine constituting a wheel loader 101. The body of the wheel loader 101 comprises a front body section 102 and a rear body section 103, which sections each has an axle 112,113 for driving a pair of wheels. The rear body section 103 comprises a cab 114. The body sections 102,103 are connected to each other in such a way that they can pivot in relation to each other around a vertical axis by means of two first actuators in the form of hydraulic cylinders 104,105 arranged between the two sections. The hydraulic cylinders 104,105 are thus arranged one on each side of a horizontal centerline of the vehicle in a vehicle traveling direction in order to turn the wheel loader 101.

The wheel loader 101 comprises an equipment 111 for handling an external load, such as objects or material. The equipment 111 comprises a load-arm unit 106 and an implement 107 in the form of a bucket fitted on the load-arm unit. A first end of the load-arm unit 106 is pivotally connected to the front vehicle section 102.

The implement 107 is pivotally connected to a second end of the load-arm unit 106.

The load-arm unit 106 can be raised and lowered relative for the front section 102 of the vehicle by-means of two second actuators in the form of two hydraulic cylinders 108, 109, each of which is connected at one end to the front vehicle section 102 and at the other end to the load-arm unit 106. The bucket 107 can be tilted relative to the load-arm unit 106 by means of a third actuator in the form of a hydraulic cylinder 110, which is connected at one end to the front vehicle section 102 and at the other end to the bucket 107 via a link-arm system 115.

Figure 2:
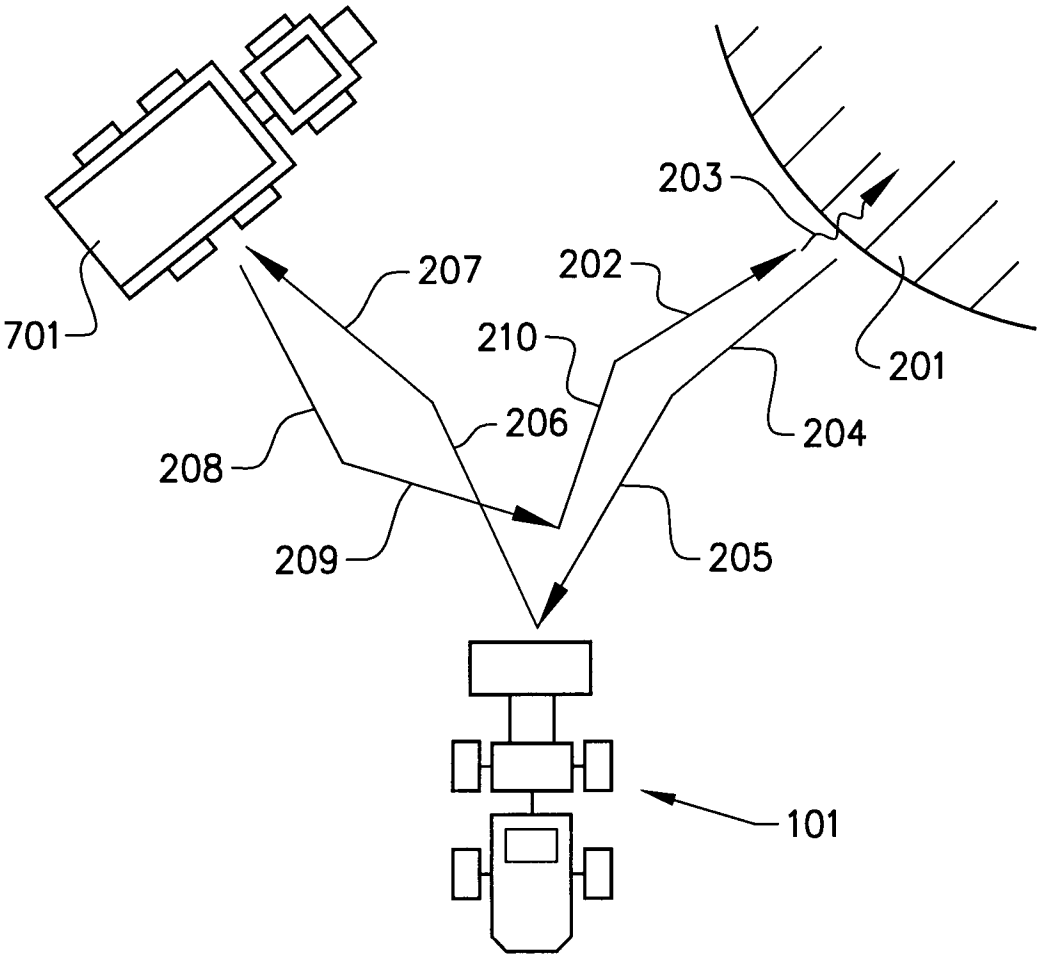
FIG. 2 illustrates a short cycle loading with the wheel loader in a view from above.

With reference to FIG. 2, a work cycle in the form of so-called short-cycle loading for the wheel loader 101 is shown. The short-cycle loading is characterized in that the longest distance that the vehicle travels between a loading and an unloading position does not exceed a certain number of meters, in this case of the order of 15 meters. More specifically, the wheel loader 101 is used to scoop up material from the loading position (excavating a natural ground 201) with the bucket 107 and unload it in the unloading position (onto a container of a dump truck 220 in the form of an articulated hauler).

FIG. 2 shows a driving pattern comprising a series of steps from excavation to loading onto the dump truck 220. Specifically, the wheel loader 101 travels forward, see arrow 202, to the natural ground 201 in for example a forward second speed gear. The wheel loader is in a straight position, wherein the front and rear vehicle parts are in line. When it approaches the natural ground 201, it thrusts into the natural ground in for example a forward first speed gear in order to increase tractive force, see arrow 203. The lifting arm unit is raised, wherein the bucket 107 is filled with material from the natural ground.

When the excavation is finished, the wheel loader 101 is retreated from the excavating operation position at a high speed in for example a reverse second speed gear, see arrow 204 and the wheel loader is turned to the right (or to the left), see arrow 205. The wheel loader 101 then moves forward, see arrow 206, while turning hard to the left (or right), then straightens out the vehicle to travel to approach the dump truck 220 at a high speed, see arrow 207. The lifting arm unit 106 is raised, the bucket 107 tilted and the material is deposited on the container of the articulated hauler. When a loading operation of the dump truck 220 is finished, the empty bucket is lowered, the wheel loader 101 moves away in reverse from the dump truck 220 at a high speed, see arrow 208, turns to a stop position and is driven forwards again 210 towards the natural ground 201.

Figure 3:
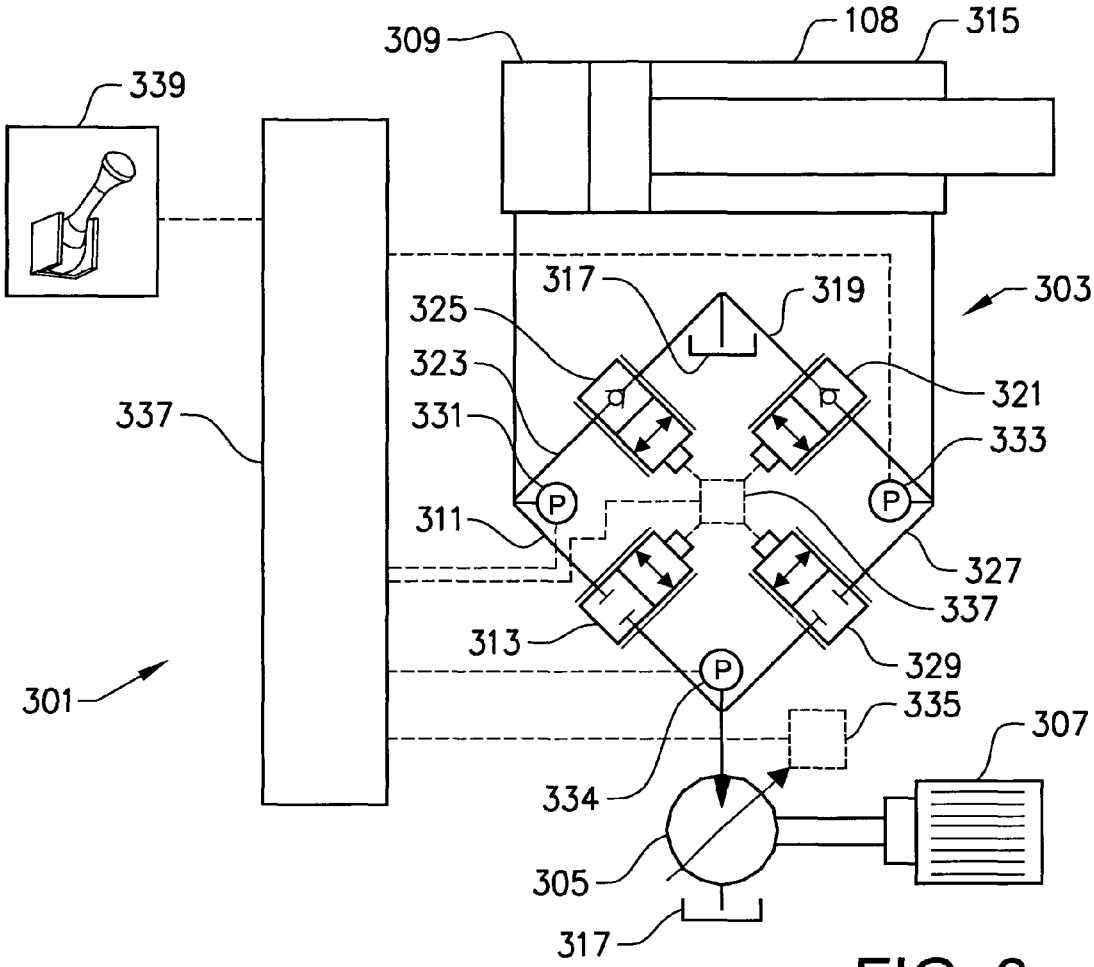
FIG. 3 shows a hydraulic system for controlling recuperation of energy in a plurality of different modes.

FIG. 3 shows a hydraulic system 301 for controlling recuperation of energy in a plurality of different modes during lowering of the load via said lifting cylinders 108,109. More specifically, FIG. 3 shows an open circuit 303 configuration comprising a hydraulic machine 305 which functions as both pump and motor. The hydraulic machine 305 is connected in a driving manner to a power source 307.

The hydraulic machine 305 therefore functions as a pump in a first operating state and supplies pressurized hydraulic fluid to the hydraulic cylinder 108. The hydraulic machine 305 also functions as a hydraulic motor in a second operating state and is driven by a hydraulic fluid flow from the hydraulic cylinder. Preferably, the pump 305 is an open-circuit, cross-center pump fully displacable in both directions.

The hydraulic machine 305 is connected to a piston side 309 of the hydraulic cylinder 108 via a first hydraulic conduit 311. A first valve 313, below referred to as the A-P valve, is arranged on the first conduit 311 for controlling the fluid flow. The A-P valve 313 is formed by a bi-directional proportional valve.

A piston rod side 315 of the hydraulic cylinder 108 is connected to a tank 317 via a second hydraulic conduit 319. A second valve 321, below referred to as the B-T valve, is arranged on the second conduit 319 for controlling the fluid flow. The B-T valve 321 is formed by an anti-cavitation check valve.

The piston side 309 of the hydraulic cylinder 108 is connected to the tank 317 via a third hydraulic conduit 323. A third valve 325, below referred to as the A-T valve, is arranged on the third conduit 323 for controlling the fluid flow. The A-T valve 325 is formed by an anti-cavitation check valve.

The hydraulic machine 305 is connected to the piston rod side 315 of the hydraulic cylinder 108 via a fourth hydraulic conduit 327. A fourth valve 329, below referred to as the B-P valve, is arranged on the fourth conduit 327 for controlling the fluid. The B-P valve 329 is formed by a bi-directional proportional valve.

A first pressure sensor 331 is adapted to sense the pressure in the piston side 309 of the hydraulic cylinder 108. A second pressure sensor 333 is adapted to sense the pressure in the piston rod side 315 of the hydraulic cylinder 108. A third pressure sensor 333 is adapted to sense the pressure in an output side of the pump 305.

The hydraulic system 301 further comprises a pump control means 335 and a valve control means 337. They can be of conventional design and will not be further described here. The pump is preferably capable of alternating between pressure and flow control but will not be further described here. The hydraulic system 301 further comprises a controller 337, which is operatively connected to the pressure sensors 331, 333, 334 for receiving pressure signals. The controller 337 is further operatively connected to the pump control means 335 and the valve control means 337 for controlling them according to a control strategy, which will be further described below. Further, an operator controlled element 339, preferably in the form of a joystick, is operatively connected to the controller 337, wherein the controller receives operator command signals.

Figure 4:
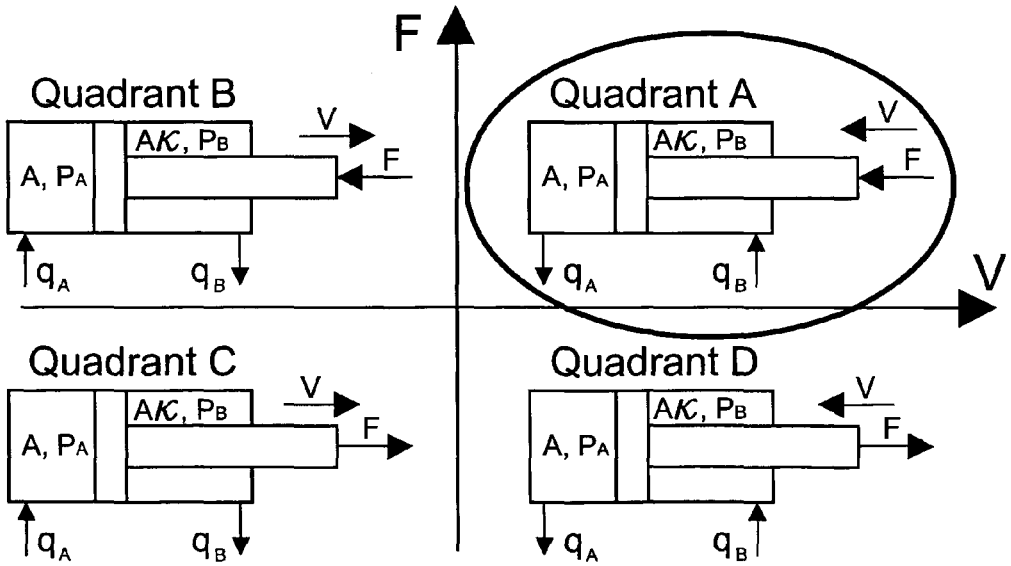
FIG. 4 shows the four different load quadrants.

The load case of interest is the recuperative motion where load force and actuator speed (hydraulic cylinder speed) has the same direction. The direction of interest is when flow leaves the cylinder piston chamber. This situation is marked with a circle in FIG. 4. A common scenario when this occurs is when lowering a hanging load. The aim is to recuperate as much energy as possible given a desired actuator speed (commanded by the operator) at a given load acting on the piston rod.

The hydraulic cylinder 108 (an asymmetric cylinder) can be actuated either with or without its chambers hydraulically connected to each other, here referred to as the differential or normal operational state of a cylinder. In either state the maximum hydraulic power must not be exceeded. By controlling pressure in the differential case—or flow in the normal case it is possible to achieve the same actuator speed at the same load force by choosing different modes of operation. The control strategy is adapted to yield the highest possible efficiency in energy recuperation.

Figure 5:
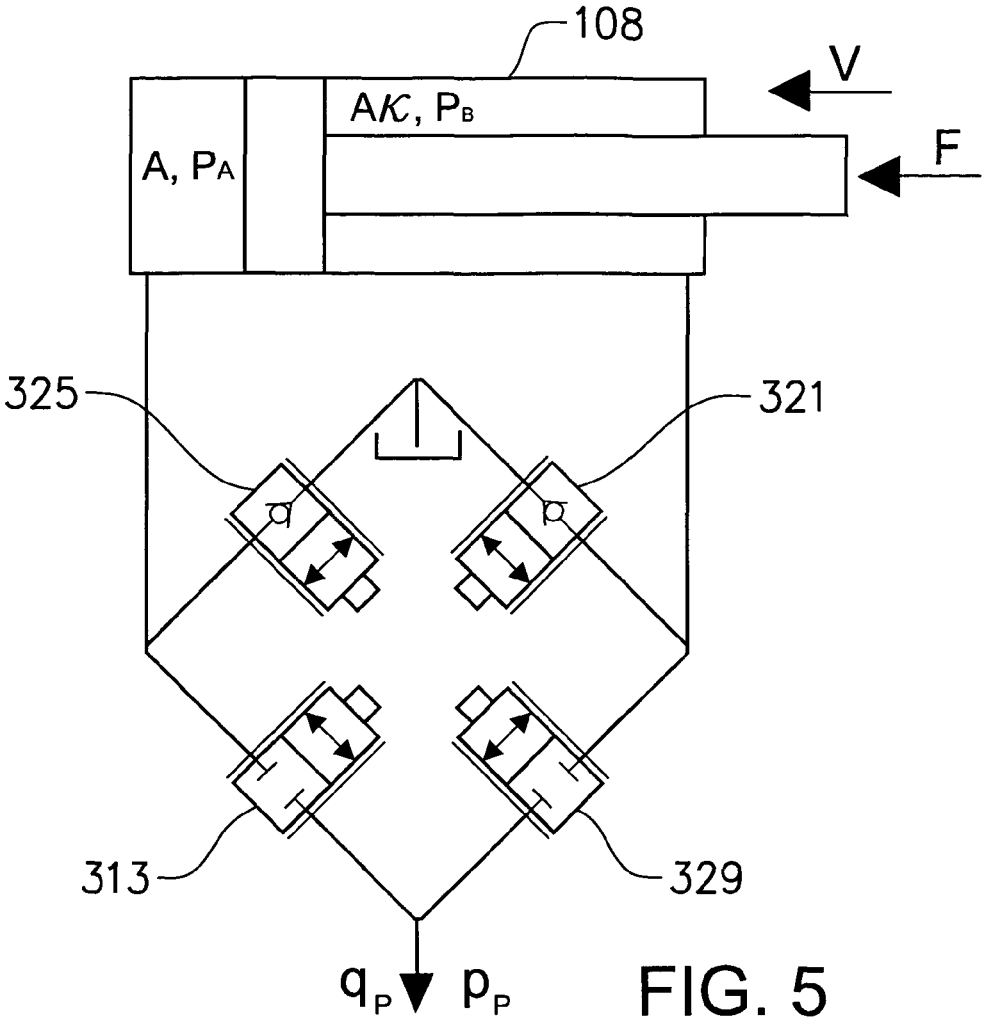
FIG. 5 shows the hydraulic circuit from FIG. 3.

FIG. 5 illustrates the hydraulic circuit, and especially the valves used when lowering the load.

- The A-T valve 325 controls the flow from the piston side (A-chamber) to tank in some control modes.
- The A-P valve 313 controls the flow from the cylinder to the hydraulic machine (also used for load holding).
- The B-T valve 321 controls the flow to the piston rod side (B-chamber) from tank (does not necessarily require active control, when implemented as an anti cavitation valve).
- The B-P valve 329 controls the flow to the B-chamber from the pump (or A-chamber if A-P valve is open). This valve is preferably adapted to be capable of pressure control in order to achieve some control modes, see further below.

The sets of combinations in having the four valves 313, 321, 325, 329 individually opened or closed are here referred to as control modes. However, not all of these combinations make sense from a control perspective. Depending on the cylinder load and desired actuator speed one mode is usually better than another, regarding the energy efficiency in recuperation. In table 1 the rules for which mode is achievable given a certain speed (v) and force (F) couple. The limits in load force and actuator velocity in the normal (index n) and differential (index d) state, expressed in maximum allowable system pressure ps,max piston area A and maximum machine flow qm,max are given by:

$$F_n^* = p_{s,max} \cdot A \tag{1}$$

$$v_n^* = \frac{q_{m,max}}{A} \tag{2}$$

$$F_d^* = F_n^* \cdot (1 - \kappa) \tag{3}$$

$$v_d^* = \frac{v_n^*}{(1 - \kappa)}, \tag{4}$$

where K is the cylinder area ratio.

TABLE 1

Description of the region of operation for each mode and the efficiency calculation.

| mode | valve A-T | valve B-P | Cylinder state | F | v | $\eta_{mode}$ |
|---|---|---|---|---|---|---|
| I | closed | closed | Normal | $<F_n^*$ | $<v_n^*$ | 1 |
| II | q-contr. | closed | Normal | $<F_n^*$ | $>v_n^*$ | $\frac{v_n^*}{v}$ |
| III | closed | open | Differential | $<F_d^*$ | $<v_d^*$ | 1 |
| IV | closed | p-contr | Differential | $>F_d^*$ | $<v_d^*$ | $\frac{F_d^*}{F}$ |
| V | q-contr. | open | Differential | $<F_d^*$ | $>v_d^*$ | $\frac{v_d^*}{v}$ |
| VI | q-contr. | p-contr. | Differential | $>F_d^*$ | $>v_d^*$ | $\frac{F_d^* \cdot v_d^*}{F \cdot v}$ |

Figure 6:
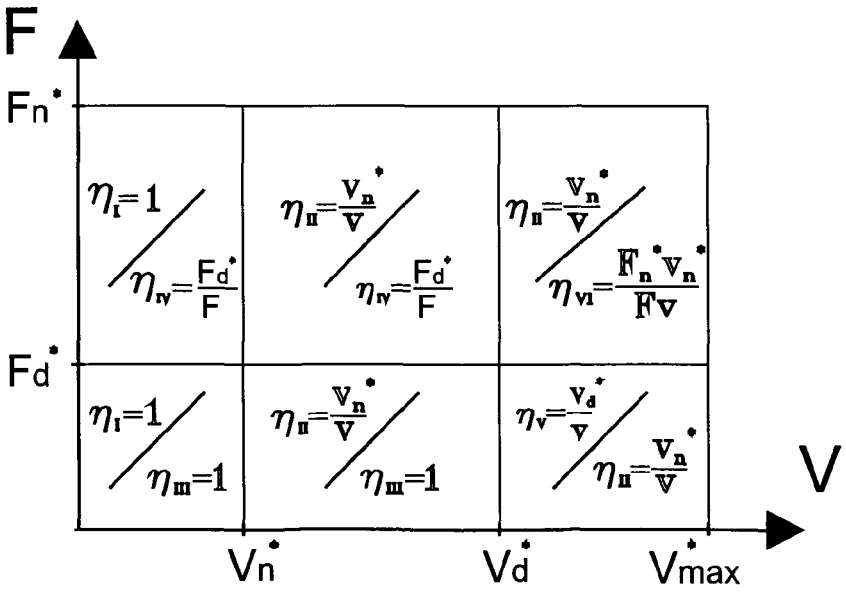
FIG. 6 shows a graph defining a plurality of different energy recuperation modes.

This can also be graphically represented over the working region in load force (F) and desired actuator speed (v), see FIG. 6.

According to a first, exemplary control strategy, the differential mode is always selected when initiating a lowering motion if this is allowed by the current pressure level. This is usually possible (depending on the cylinder area ratio) when lowering an empty bucket (which is usually the case when the wheel loader is used to load gravel, see description above with regard to FIG. 2).

When the joystick signal is zero and the displacement sensor indicates a relative pump displacement close to zero, all the valves will be closed. This mode should preferably always be activated before differential or normal mode is entered.

In the mode "Down normal" the machine is always capable of lowering loads up to the maximum specified loading capacity. When receiving a negative joystick signal the controller verifies that the pressure in the A-chamber is higher than the pressure in B-chamber and the pump pressure lies within a specified limit. The pump operates as motor during "down normal".

If the regulator confirms the following conditions the "Down normal" mode is selected and entered:

Lift/Tilt:

- Joystick signal is negative.
- The pump pressure exceeds pressure in A-chamber+a bias setting.
- The pressure in A-chamber exceeds pressure in B-chamber+a bias setting.
- Pre differential lowering is not active.

Figure 7:
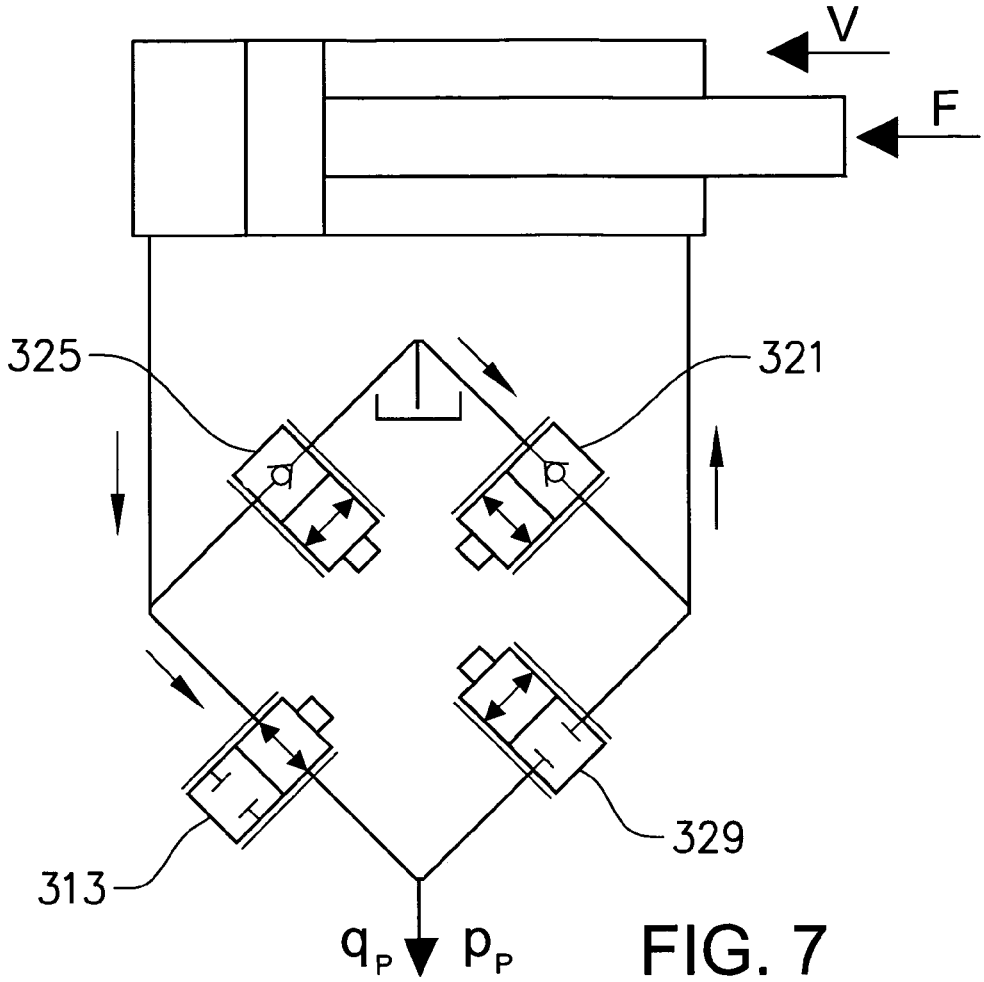
FIG. 7-8 show an example of a first mode.
Figure 8:
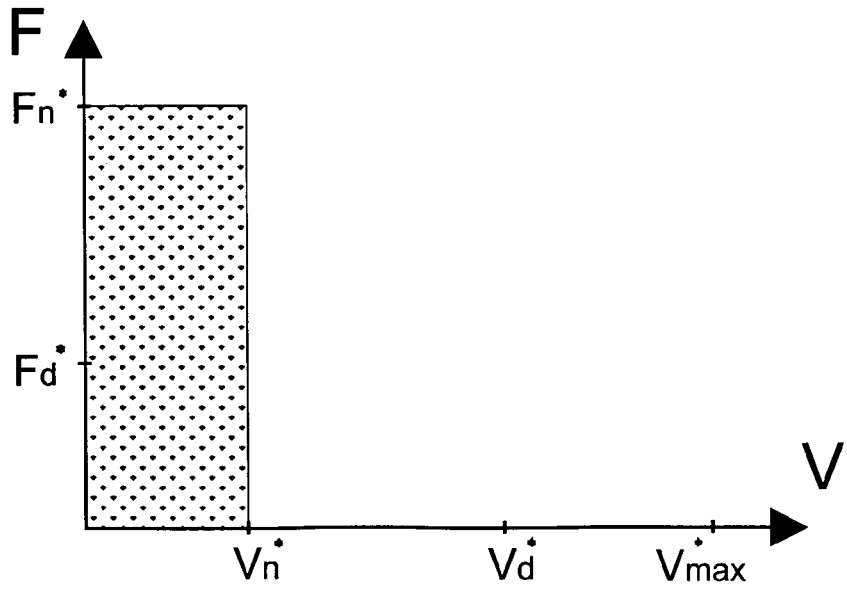

Valve conditions when "Down normal" mode is entered:

- AP-valve is opened
- AT-valve is closed
- BP-valve is closed
- BT-valve is opened See FIGS. 7-8.

The mode "Down differential" makes it possible to lower the bucket with a higher speed than down normal. The concept of differential lowering is to open the B-P valve and the A-P valve to connect the two chambers, this result in that oil from the A-chamber is used to refill the B-chamber and the remaining oil exits to pump. The oil that exits through pump equals the volume of the cylinder rod. It also results in a pressure increase since the load now rests on the area of the cylinder rod. The pressure increase depends on the area ratio of the cylinder which may differ in the lift and tilt drive. The pressure increase in some cases makes it inappropriate to use the differential mode, as this would damage the system. If the load pressure times the pressure increase factor exceeds the maximum allowed pressure, differential lowering is not allowed. Before the differential lowering is started a "pre-differential condition" has to be fulfilled (this is only necessary in case the semi differential mode is not supported for in hardware).

If the controller confirms the following conditions the "Down differential" mode is entered:

Lift/Tilt:

- The "Pre-differential condition" has the value of 1 (described below).
- The pump pressure exceeds the pressure in A-chamber+a bias setting.
- The pressure, in A-chamber exceeds the pressure in B-chamber.

Figure 9:
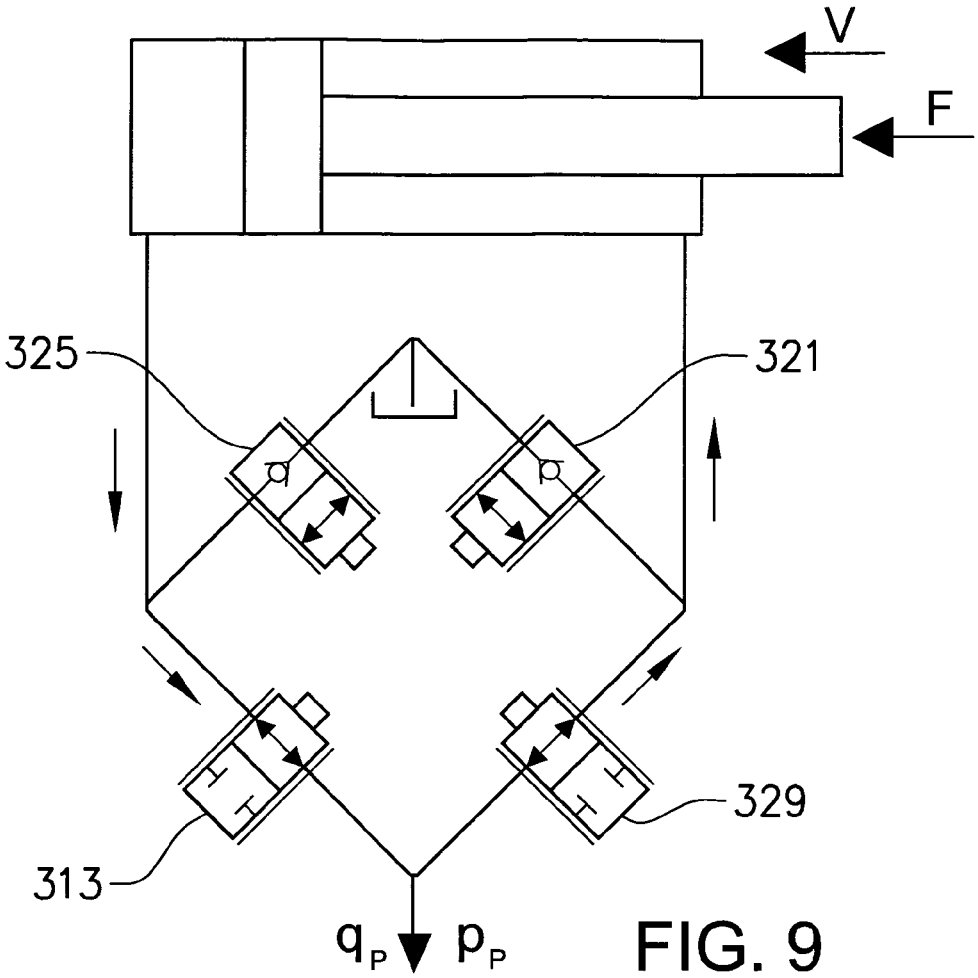
FIG. 9-10 show an example of a second mode.
Figure 10:
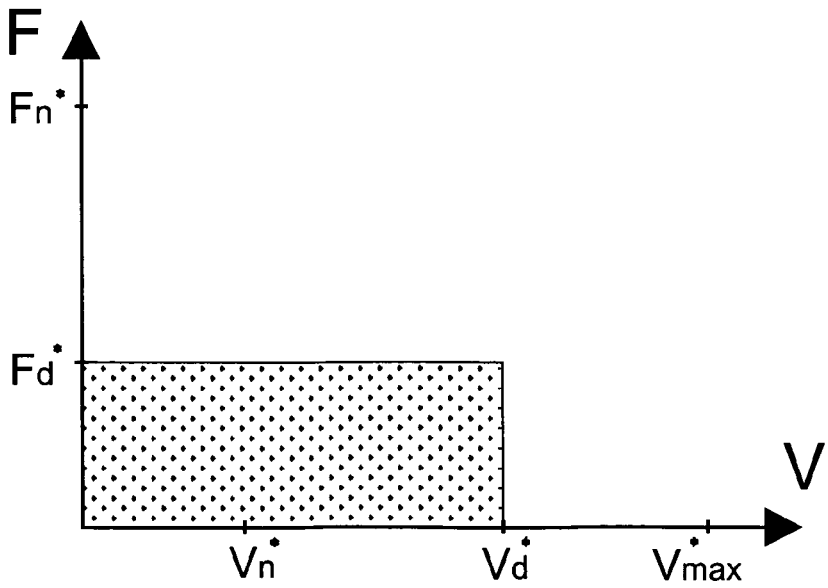

Valve conditions when "Down differential" mode is entered:

- AP-valve is opened
- BP-valve is opened
- AT-valve is closed
- PT-valve is closed See FIGS. 9-10.

To enable the differential lowering mode, it is important that maximum differential pressure does not exceed maximum system pressure. Therefore the pressure after entering differential mode has to be calculated and compared to the maximum system pressure. This is done by measuring the pressure when the operator touches the joystick and then calculates what the resulting pressure in differential mode will become given that measured pressure and the cylinder area ratio, K. If the calculated resulting pressure is lower than the maximum system pressure the pump must be actively controlled to meet the load pressure prior to opening the A-P valve. When this is achieved, the "Pre-differential lowering" parameter is set to 1 and the "Down differential" mode is allowed.

The meter-out function makes it possible to lower the bucket with a higher speed than the ordinary normal mode and eventually also a higher speed than the differential lowering mode would allow. If the pump is saturated (maximum negative relative-displacement) but the lowering speed is still to low, the A-T valve is proportionally controlled to achieve the desired lowering speed. In order to control the A-T valve the "flow that exits trough pump" and the "required lowering speed" are calculated.

When the joystick signal is negative the meter out regulator calculates three parameters, "flow that must exit the cylinder", "required pump flow" and "A-T flow". If the required pump flow is not achievable the excess flow will be equal to the calculated A-T flow which is used to generate the control signal for the A-T valve.

(If the calculated value of AT is less than zero it means that the pump is capable of handling the flow from cylinder at desired lowering speed and the parameter is therefore set to zero. Otherwise the A-T valve is continuously controlled by an algorithm to achieve desired lowering speed.)

If the controller confirms the following conditions the "Down normal meter-out" function is entered:

Lift/Tilt:

Joystick signal is negative

The mode is "Down normal".

If the calculated A-T valve signal is less than zero, the A-T valve control signal is set to zero.

Figure 11:
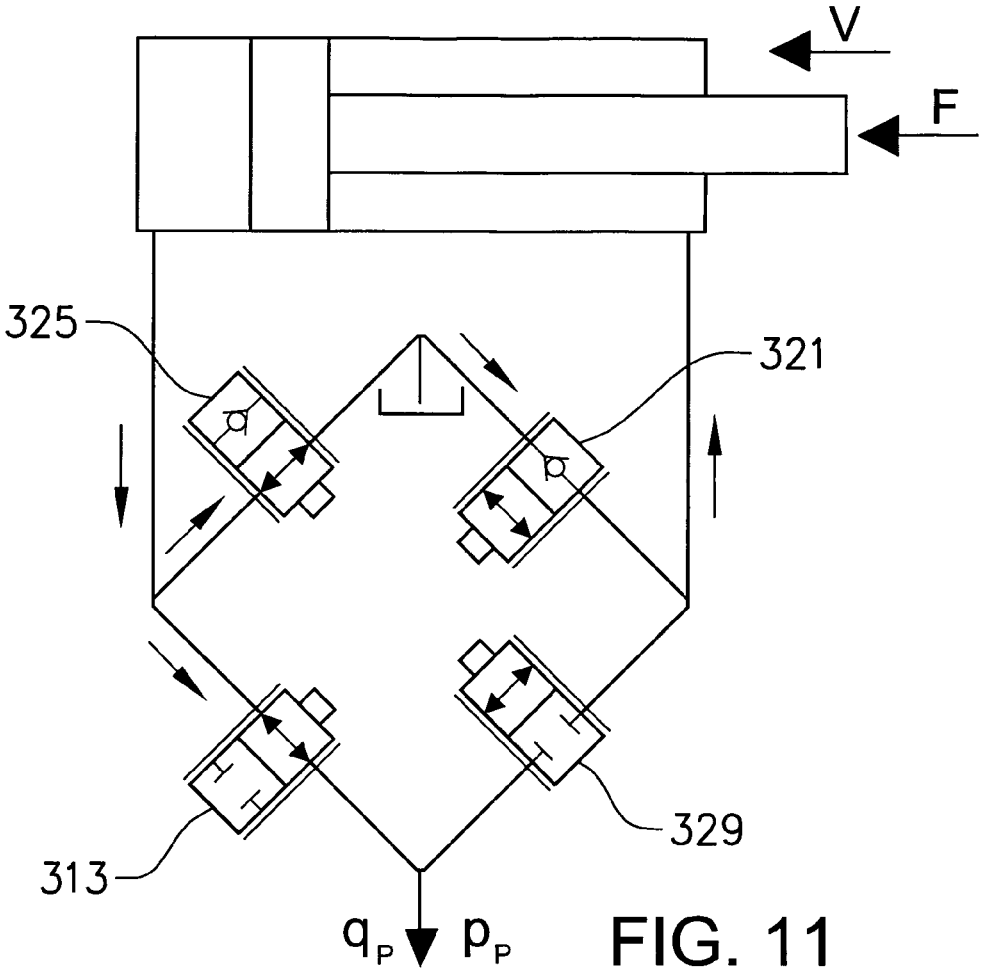
FIG. 11-12 show an example of a third mode.
Figure 12:
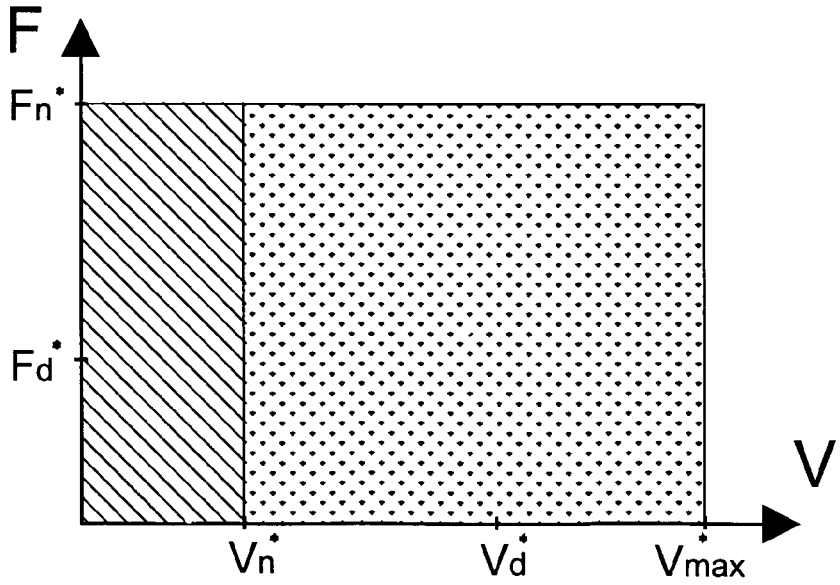

Else the required A-T valve control signal is calculated continuously. See FIGS. 11-12.

If the controller confirms the following conditions the "Down differential meter-out" function is entered: Lift/Tilt Joystick signal is negative The mode is "Down differential".

If the value of the A-T valve signal is less than zero, the A-T valve signal is set to zero.

Figure 13:
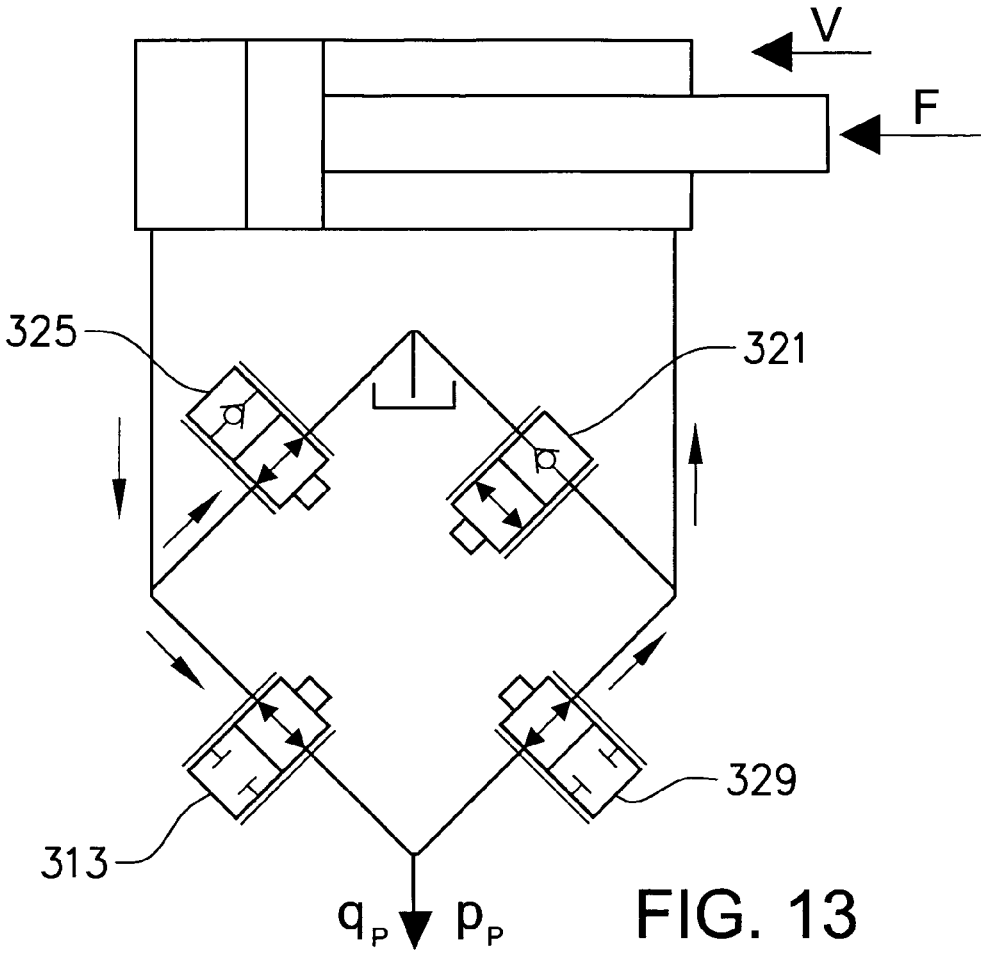
FIG. 13-14 show an example of a fourth mode.
Figure 14:
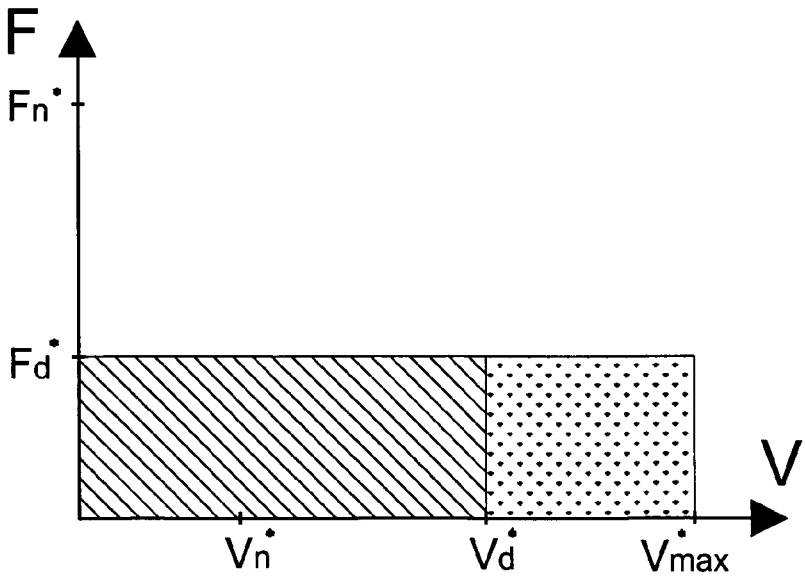

Else the required A-T valve control signal is calculated continuously. See FIGS. 13-14.

According to a further example, the control strategy comprises a Pre meter-out mode (increased smoothness and response). This function is implemented to achieve the best possible response of a lowering in lift or tilt mode. The A-T valve between load side and tank is continuously controlled in a proportional manner. If all conditions required to start a lowering motion are fulfilled a smooth start can be achieved by initially controlling flow over the valves. Meanwhile, the pump is pressure controlled until the load pressure has been reached; thereafter velocity control is taken over by the pump. This measure yields an improved system response time, with only a minor power loss as a consequence.

When joystick signal is negative and the previous mode is "stop", the algorithm continuously controls the opening of either the A-T or A-P valve in order to rapidly get the motion going.

If the regulator confirms the following conditions the "Pre meter-out" function is entered:

Lift/Tilt:

Joystick signal is negative.

The mode is "Stop".

The value of A-T valve signal is calculated according to an algorithm.

Figure 15:
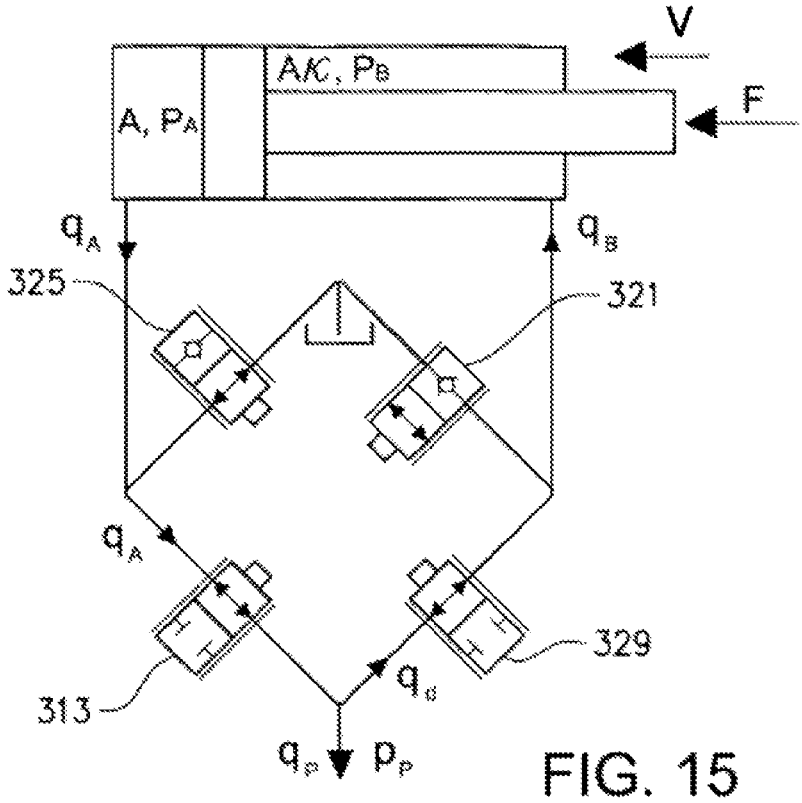
FIG. 15-16 show an example of a fifth mode.
Figure 16:
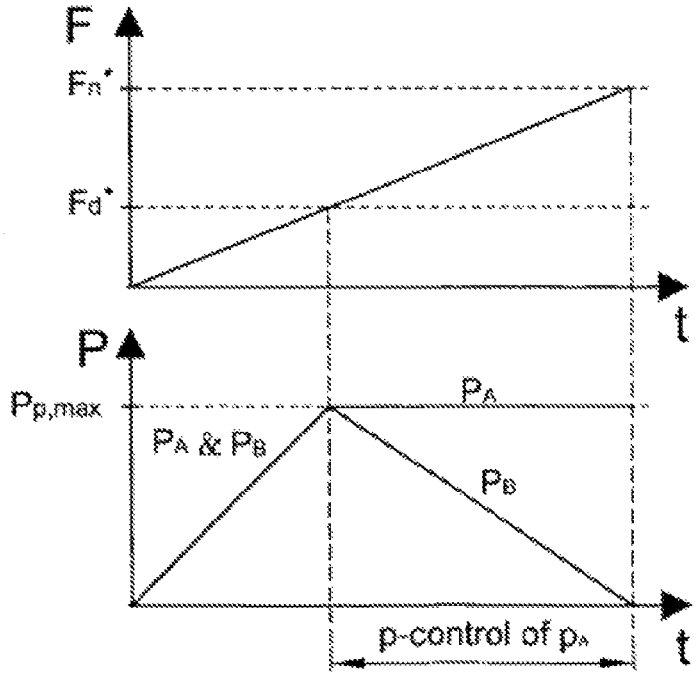

In case the differential mode is active, and the load pressure rises above the limit for the differential mode, pressure control can be applied. By taking this measure the pressure in the A-chamber can be maintained at a maximum value. This of course only happens if this mode is supported for in hardware (B-P valve capable of pressure control). How this works is illustrated in FIGS. 15-16.

According to a further development of the control strategy described above, a so-called adaptive solution will be explained below. This strategy can still involve some or all of the modes described above.

Either the differential mode or the normal mode can be chosen for any working condition. This makes it interesting to choose the most efficient mode before the motion is initialized. The selection of mode is made adaptive by creating conditions for changing the control strategy after analyzing historical measurement data.

This strategy does not require any further sensors. Input to the calculation is pressure and joystick signal. Output is which mode should be selected when starting a lowering (recuperative) motion.

Figure 17:
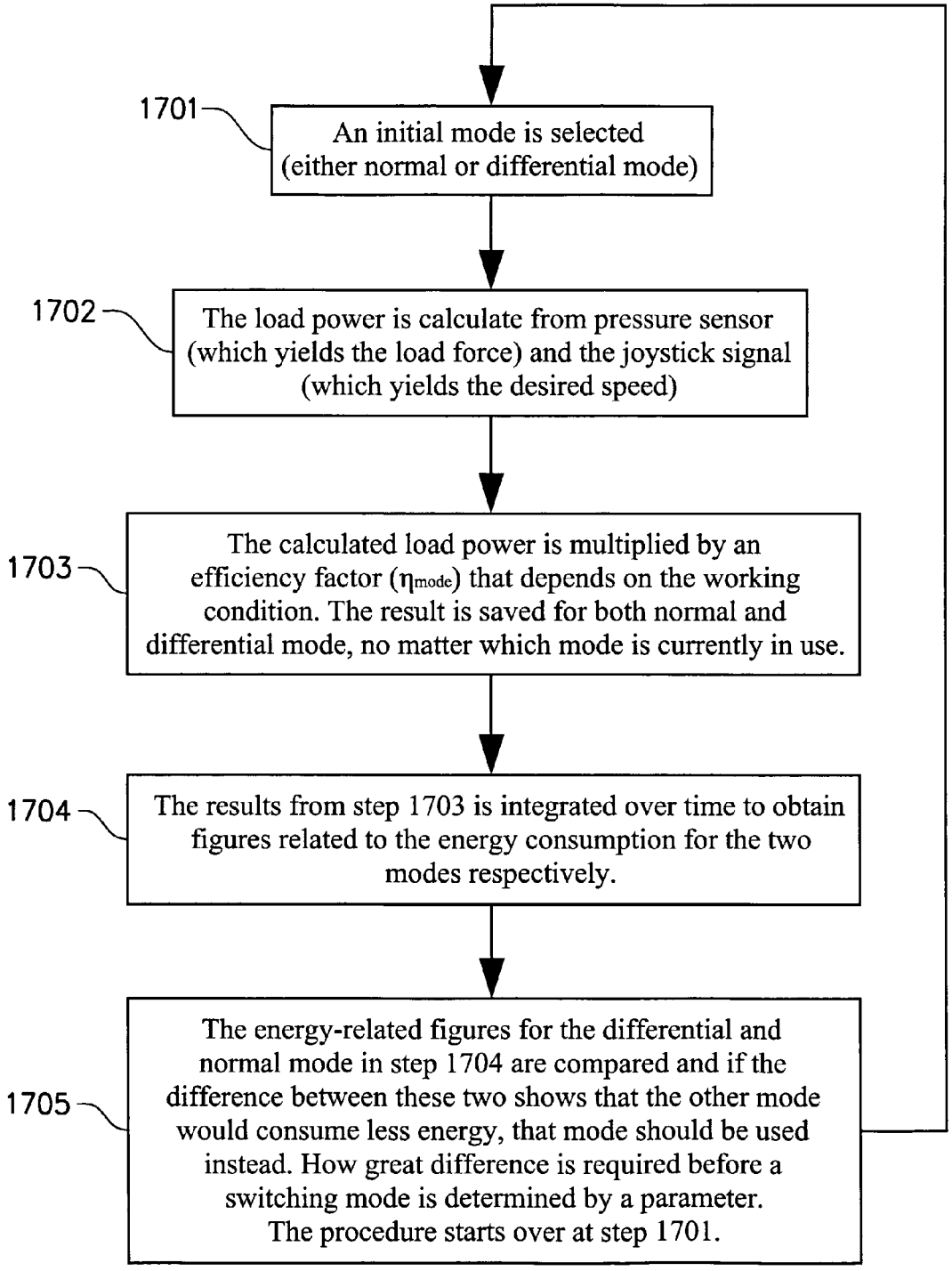
FIG. 17 shows a block diagram of an exemplary adaptive control method.

The fundamental steps in such a controller are shown by FIG. 17. In the first step 1701, an initial mode (either normal mode or differential mode) is selected when starting the wheel loader (i.e. before any-lowering motion has been initiated in a specific working period). The initial mode can for example be automatically selected depending on the operation in a previous working period, or be randomly selected, or selected based on an operator input. In the next step 1702, The load power is calculate from pressure sensor (which yields the load force) and the joystick signal (which yields the desired speed). In the next step 1703, The calculated load power is multiplied by an efficiency factor ($\eta$mode) that depends on the working condition. The result is saved for both normal and differential mode, no matter which mode is currently in use. In the next step 1704, the results from the previous step 1703 is integrated over time to obtain figures related to the energy consumption for the two modes respectively. In the next step 1705, the energy-related figures for the differential and normal mode from the previous step 1704 are compared and if the difference between these two shows that the other mode would consume less energy, that mode should be used instead. How great difference is required before a switching mode is determined by a parameter. The procedure starts over at the first step 1701.

It would also be appropriate to have the possibility to manually turn off the differential state selection. This could be an advantage in some fields of applications where the load dynamics is of high importance. The differential state of operation leads to a significantly lower resonance frequency which in some cases in not desired, for example when precision in actuation is of high importance.

The controller 337 is commonly known as a central processing unit (CPU) or an electronic control module (ECM) for an electronic control of the vehicle operation. In a preferred embodiment, the control unit comprises a microprocessor. The control unit 337 comprises a memory, which in turn comprises a computer program with computer program segments, or a program code, for implementing the control method when the program is run. This computer program can be transmitted to the control unit in various ways via a transmission signal, for example by downloading from another computer, via wire and/or wirelessly, or by installation in a memory circuit. In particular, the transmission signal can be transmitted via the Internet.

The hydraulic system is preferably adapted for being able to lower the load at about twice the speed of lifting the load. Further, the control method creates conditions for minimizing the pump size. With regard to conventional work machine systems with pump-controlled lifting/lowering, a very large pump is required in order to handle the large flow during the lowering motion.

According to the control method, the motor will operate at a higher pressure as often as possible, where it usually has a higher efficiency. Thus, it is an efficient way of recuperating the available potential energy.

The invention is not in any way limited to the above described embodiments, instead a number of alternatives and modifications are possible without departing from the scope of the following claims.

According to one example, the recuperated potential energy during the lowering operation is preferably transferred to a power consuming system, such as the work machine powertrain. The recuperated potential energy during the lowering operation is preferably transferred to the power source (diesel engine). According to an alternative, the recuperated potential energy during the lowering operation is transferred to other hydraulic functions, such as the steering or tilting function. According to a further alternative, the recuperated potential energy is transferred to a cooling fan motor. The recuperated potential energy transferred to the power consuming system is preferably simultaneously consumed in the power consuming system.

According to another example, a primary mover (electrical machine) of the hydraulic machine could be coupled to an electric hybrid system with energy storage capabilities.

Additionally, it should be noted that the essence of the suggested control strategies is not only applicable to the open circuit solution but to all hydraulic recuperative solutions where an asymmetric cylinder is used along with four separate valves.

In FIG. 3 each drive has three pressure sensors, which is a prerequisite to achieve all the modes of operation described in this document. However, in a practical implementation some or all of these sensors might be redundant depending on which modes of operation are suitable for the given application. Moreover, some or all of the sensors can be replaced with hydromechanical solutions, achieving the same result.

For example, the control method may be performed via a control system for a work machine, the system comprises a hydraulic machine and at least one hydraulic cylinder which is configured to lift and lower a load, the hydraulic machine being connected to a piston side of the hydraulic cylinder via a first line and a piston-rod side of the hydraulic cylinder via a second line, the hydraulic machine being adapted to supply the hydraulic cylinder with pressurized hydraulic fluid from a tank in a lifting operation and to be driven by a hydraulic fluid flow from the hydraulic cylinder in a lowering operation, the hydraulic machine is mechanically connected to a power consuming system for transferring recuperated potential energy during the lowering operation to the power consuming system.

According to an alternative method for recuperating potential energy during a lowering operation of a load, wherein a hydraulic cylinder is configured to lift and lower the load, the method comprises the steps of mechanically transferring the recuperated potential energy from a hydraulic machine, which is driven by a hydraulic fluid flow from the hydraulic cylinder during the lowering operation, to a power consuming system and simultaneously consuming the recuperated energy in the power consuming system. This alternative method can be combined with any steps of the control method described above.

The invention claimed is:

1. A method for recuperating potential energy during a lowering operation of a load, wherein a hydraulic system is adapted to lift and lower the load, the hydraulic system comprising a hydraulic actuator comprising a hydraulic cylinder which comprises a piston rod, a piston side and a piston-rod side, and a hydraulic machine which functions as both pump and motor, comprising providing at least two energy recuperation modes, a first mode enabling fluid communication between the piston-rod side and the piston side in the hydraulic cylinder and enabling fluid communication between the piston side and the hydraulic machine, a second mode preventing fluid communication between the piston-rod side and the piston side in the hydraulic cylinder and enabling fluid communication between the piston side and the hydraulic machine, determining, for a current operating state representative of at least a desired actuator speed at a given load acting on the piston rod, an amount of energy that can be recuperated for each one of the modes, selecting, with respect to constraints of the hydraulic system used with regard to at least a maximum system pressure, one of the modes in response to the current operating state, and controlling the hydraulic system according to the selected mode.

2. A method according to claim 1, wherein the first energy recuperation mode corresponds to a load an assembly, which is adapted to lift and lower the load, being lowered with substantially no external load.

3. A method according to claim 2, wherein the load arm assembly comprises a work implement adapted to carry the external load.

4. A method according to claim 1, wherein a second energy recuperation mode corresponds to a load arm assembly, which is adapted to lift and lower the load, being lowered with a substantial external load.

5. A method according to claim 1, comprising detecting at least one operational parameter and determining the current operating state in response thereto.

6. A method according to claim 5, wherein a first operational parameter is indicative of a load state.

7. A method according to claim 6, comprising selecting one of the energy recuperation modes, for which the hydraulic system is capable of lowering the load defined by the load state.

8. A method according to claim 6, wherein the first operational parameter is indicative of a pressure level in the hydraulic system.

9. A method according to claim 6, wherein a second operational parameter is indicative of an operator commanded speed of the lowering motion.

10. A method according to claim 9, comprising selecting one of the energy recuperation modes, for which the hydraulic system is capable of lowering the load in accordance with the commanded speed.

11. A method according to claim 5, comprising repeatedly detecting the at least one operational parameter during operation in a repeated work cycle, and determining the current operating state based on detected values of the operational parameter during performance of at least one of the work cycles.

12. A method according to claim 11, comprising repeatedly detecting the at least one operational parameter during operation in one of the at least two energy recuperation modes in the repeated work cycle, determining which of the at least two energy recuperation modes is most energy efficient for the specific work cycle, and responsively selecting the most energy efficient recuperation mode.

13. A method according to claim 1, wherein the hydraulic machine is controlled by variably controlling a swash plate angle.

14. A method according to claim 1, wherein the hydraulic machine is controlled by controlling the hydraulic machine shaft speed.

15. A method according to claim 1, comprising transferring the recuperated potential energy from a hydraulic machine, which is driven by a hydraulic fluid flow from the hydraulic actuator during the lowering operation.

16. A method according to claim 1, comprising controlling a flow from a piston side in the hydraulic cylinder during the lowering operation.

17. A method according to claim 1, wherein the first mode involves throttling by means of a flow control valve arranged in a line connecting the piston-rod side and the piston side.

18. A method according to claim 1, wherein the hydraulic system is arranged in a work machine.

19. A method according to claim 1, comprising recuperating energy by operating the hydraulic machine in the second operating state.

* * * * *